US012285070B2

(12) United States Patent
Thomas et al.

(10) Patent No.: US 12,285,070 B2
(45) Date of Patent: Apr. 29, 2025

(54) MODULAR HELMET SYSTEM

(71) Applicant: ABUS August Bremicker Söhne KG, Wetter-Volmarstein (DE)

(72) Inventors: Yannik Thomas, Wetter (DE); Frank Riederer, Dortmund (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 18/520,622

(22) Filed: Nov. 28, 2023

(65) Prior Publication Data

US 2024/0188669 A1 Jun. 13, 2024

(30) Foreign Application Priority Data

Dec. 7, 2022 (DE) ..... 102022132430.3

(51) Int. Cl.
*A42B 3/08* (2006.01)
*A42B 3/16* (2006.01)
*A42B 3/32* (2006.01)

(52) U.S. Cl.
CPC ..... *A42B 3/08* (2013.01); *A42B 3/16* (2013.01); *A42B 3/32* (2013.01); *A42B 3/326* (2013.01)

(58) Field of Classification Search
CPC .... A42B 3/08; A42B 3/16; A42B 3/32; A42B 3/326; A42B 3/205
See application file for complete search history.

(56) References Cited

U.S. PATENT DOCUMENTS

| | | | | |
|---|---|---|---|---|
| 5,619,755 | A * | 4/1997 | Casartelli | A42B 3/326 2/424 |
| 10,492,559 | B1 * | 12/2019 | Kele | A42B 3/326 |
| D931,546 | S | 9/2021 | Krauter | |
| 2002/0043012 | A1 | 4/2002 | Shibata et al. | |
| 2008/0066355 | A1 | 3/2008 | Misawa et al. | |
| 2009/0044316 | A1 * | 2/2009 | Udelhofen | A63B 71/10 2/9 |
| 2013/0025034 | A1 * | 1/2013 | Durocher | A42B 3/16 2/410 |
| 2019/0014852 | A1 * | 1/2019 | An | A42B 3/326 |
| 2022/0125149 | A1 * | 4/2022 | Fu | A42B 3/326 |

FOREIGN PATENT DOCUMENTS

| | | | |
|---|---|---|---|
| CN | 201831006 | U | 5/2011 |
| CN | 203262379 | U | 11/2013 |
| DE | 3214020 | A1 | 7/1983 |
| DE | 69410439 | T2 | 10/1998 |

(Continued)

*Primary Examiner* — Aiying Zhao
(74) *Attorney, Agent, or Firm* — Dickinson Wright PLLC

(57) ABSTRACT

A modular helmet system comprises a helmet and a chin bar detachably mountable to the helmet. The helmet comprises two receiving-brackets. The chin bar may be inserted into the receiving-brackets of the helmet with its two ends in front in a substantially straight line, wherein the chin bar is lockable in the receiving-brackets in an end position. Each of the two receiving-brackets comprises two insertion flanks which extend towards each other along the direction of insertion at an acute centering angle, wherein the insertion flanks are configured to center the chin bar in the vertical direction when being inserted and to form a stop for the chin bar in the end position of the chin bar.

18 Claims, 3 Drawing Sheets

(56) References Cited

FOREIGN PATENT DOCUMENTS

| | | | | | |
|---|---|---|---|---|---|
| DE | 10240744 | B3 | | 4/2004 | |
| DE | 102014109193 | A1 | | 1/2016 | |
| DE | 102014218041 | A1 | | 3/2016 | |
| DE | 102020207719 | A1 | | 12/2021 | |
| EP | 0680703 | A1 | | 11/1995 | |
| EP | 1059043 | A1 | | 12/2000 | |
| EP | 2522238 | A2 | | 11/2012 | |
| EP | 3430929 | A1 | | 1/2019 | |
| EP | 3164023 | B1 | | 7/2020 | |
| EP | 3451865 | B1 | | 5/2021 | |
| EP | 3708016 | B1 | | 8/2021 | |
| EP | 3928651 | A1 | | 12/2021 | |
| EP | 3108199 | B1 | | 4/2022 | |
| FR | 2876005 | A1 | * | 4/2006 | ..... A42B 3/225 |
| IT | MI20100510 | A1 | * | 9/2011 | ..... A42B 3/326 |
| IT | 201900001857 | A1 | | 8/2020 | |
| WO | WO-8400878 | A1 | * | 3/1984 | ..... A42B 3/326 |
| WO | 2017070685 | A1 | | 2/2004 | |
| WO | 2013186190 | A1 | | 12/2013 | |
| WO | 2015134995 | A1 | | 9/2015 | |
| WO | 2019169354 | A1 | | 9/2019 | |
| WO | 2022096918 | A1 | | 5/2022 | |

* cited by examiner

MODULAR HELMET SYSTEM

CROSS-REFERENCE TO RELATED APPLICATION

This application claims the benefit and priority of German Patent Application No. DE 102022132430.3 filed on Dec. 7, 2022. The entire disclosure of the above application is incorporated herein by reference.

FIELD OF THE INVENTION

The invention relates to a modular helmet system comprising a helmet and a chin bar detachably mountable to the helmet.

BACKGROUND OF THE INVENTION

The helmet may generally relate to a sports helmet. The helmet serves to protect the user (helmet wearer) from head injury, particularly in the event of a fall. In the present context, the term "sports helmet" is to be understood broadly and refers not only to helmets that are designed exclusively or specifically for the practice of a sport (such as a riding helmet or ski helmet), but are also used, for example, for a recreational activity (e.g. as a bicycle helmet or motorcycle helmet).

For some sports, such as mountain biking, it may be desirable to wear a helmet with a chin bar that also protects the user's face, particularly in the region of the lower jaw (so-called full face helmet). However, wearing an additional chin bar may not necessarily be desired all of the time, for example, when the user wishes to have a lighter weight helmet or a larger field of vision. In this case, a helmet that is open in the area of the face and the ears is preferred (so-called open face helmet). In some cases, the user may also want to wear a helmet with increased lateral protection, i.e. with protection also in the area of the ears (so-called jet helmet).

In such cases, it is advantageous to have a modular helmet system that includes a helmet and a chin bar that can be detachably (i.e. non-destructively) mountable to the helmet. This provides a 2-in-1 modular system in which, depending on the desired application, the chin bar may be selectively mounted to or detached from the helmet so as to convert the helmet selectively to a full face configuration or an open face configuration. With such a helmet system, it is important that the mounting of the chin bar to the helmet may be carried out easily and in a stable and reliable manner.

SUMMARY OF THE INVENTION

It is an object of the present invention to provide a modular helmet system comprising a helmet and a chin bar which is detachably mountable to the helmet, wherein the mounting of the chin bar to the helmet should be as simple as possible for the user and yet should be stable and reliable.

This object is solved by a modular helmet system having the features of claim 1.

The modular helmet system comprises a helmet and a chin bar which is detachably mountable to the helmet. The helmet comprises two receiving-brackets, wherein the chin bar is insertable with its two ends in front along an insertion direction in a substantially straight line into the receiving-brackets of the helmet. In an end position, the chin bar is lockable in the receiving-brackets in order to lock the chin bar in the end position to the helmet and thereby secure it to the helmet. Each of the two receiving-brackets comprises two insertion flanks which extend towards each other along the insertion direction at an acute centering angle. The insertion flanks are configured to center the chin bar in the vertical direction when being inserted and to form a stop for the chin bar in the end position of the chin bar.

With this helmet system, the chin bar comprises two ends which may be inserted into a respective receiving-bracket of the helmet, in particular at a front side of the helmet. The receiving-brackets may form front-facing openings for insertion of the chin bar. Each of the two receiving-brackets of the helmet comprises two insertion flanks for the respective end of the chin bar, which extend towards each other at an acute centering angle in the direction to the rear side of the helmet. Thus, the chin bar may be inserted into the receiving-brackets of the helmet from the front in a substantially straight line (i.e. translationally), whereby, if necessary, certain centering movements take place which are effected in the vertical direction due to the insertion flanks of the receiving-brackets, wherein, however, no additional (active) pivoting movement of the chin bar is required. It is also not necessary to spread the chin bar in order to insert the chin bar into the helmet. The user may thus insert the chin bar into the helmet in an easy manner, even while the user is wearing the helmet since only a straight inserting movement and application are required and the insertion flanks of the receiving-brackets guide the movement of the ends of the chin bar.

The insertion flanks also serve as a stop in order to define a tactile end position of the chin bar in which the chin bar comes to rest at the end of the insertion movement and occupies the correct orientation. In this end position, the chin bar may be locked in the receiving-brackets. The locking may be effected by manual operation or, in some embodiments, may take place automatically, as will be further explained below.

As to said acute centering angle of the respective pair of insertion flanks, the centering angle may generally be greater than zero degrees and less than 90 degrees.

In addition to centering in the vertical direction, in some embodiments the receiving-brackets of the helmet may also be configured to effect lateral guidance and/or centering of the insertion movement of the chin bar (i.e. in the horizontal direction).

The directions made in connection with the invention generally refer to a wearing position of the helmet as intended.

With regard to the further design of the helmet—in particular as a sports helmet, for example, a mountain bike helmet—the helmet may comprise a helmet body for example, which generally may have a convex shaped outer side and a concave shaped inner side facing the user's head. The helmet body is intended to absorb as much as possible the kinetic energy applied to the helmet by inelastic and/or elastic deformation during an impact. In some embodiments, the helmet body may comprise an impact absorbing shell (for example, made of expanded polystyrene, EPS), an outer shell (for example, made of ABS or polycarbonate) and an inner lining or padding. Further, in some embodiments, the helmet body may comprise a plurality of vents. In some embodiments, the helmet may also comprise a helmet strap for securing the helmet body to the user's head.

Further advantageous embodiments are explained below.

The insertion flanks of the respective receiving-bracket of the helmet may be formed, at least in sections, in straight lines along the insertion direction.

The two insertion flanks of the respective receiving-bracket may be arranged vertically one above the other to form a lower and an upper insertion flank.

In some embodiments, the cross-section of the respective insertion flank may extend horizontally when viewed in a vertical sectional plane which extends perpendicular to the direction of insertion of the chin bar, in order to form a planar guide track.

In some embodiments, each of the two insertion flanks of the respective receiving-bracket may be oriented at an acute angle with respect to a horizontal plane.

In some embodiments, the two insertion flanks of the respective receiving-bracket may be oriented symmetrical with respect to the direction of insertion of the chin bar.

The centering angle formed by the two insertion flanks of the respective receiving-bracket may in particular have a value in a range from 30 degrees to 60 degrees, for example about 40 degrees, about 45 degrees or about 50 degrees. These values relate at least to a respective section of the two insertion flanks, in particular, to two mutually opposite sections of the two insertion flanks. The centering angle may also vary along the insertion direction of the chin bar, in particular in the case of a curved development of one or both insertion flanks.

The aforementioned measures contribute to facilitating the insertion of the chin bar into the receiving-brackets of the helmet, in that the ends of the chin bar are guided and centered along the insertion direction, whereby a simple straightforward application of force suffices.

With regards to the design of the chin bar, in some embodiments the chin bar may comprise a respective insertion wedge at each of its two ends, wherein the respective insertion wedge comprises two abutment flanks which are configured, at least in sections, to be complementary to the insertion flanks of the respective receiving-bracket of the helmet, wherein in the end position of the chin bar the abutment flanks lie in a form-fit manner against the insertion flanks of the respective receiving-bracket. In this way, during insertion of the chin bar, the chin bar is guided effectively and in a manner that can be easily felt by the user, and in the end position, the chin bar may be held stably in the receiving-brackets with respect to its position and orientation.

In some embodiments, each of the two insertion wedges of the chin bar may comprise an insertion section having a trapezoidal contour, particularly with respect to a vertical plane.

In some embodiments, each of the two receiving-brackets of the helmet may have a support groove at at least one of the two insertion flanks, wherein each of the two insertion wedges of the chin bar has a respective support rib at at least one of the two abutment flanks, the respective support rib projecting in a vertical direction from the respective abutment flank, and wherein the respective support rib is configured to engage the support groove of the respective receiving-bracket in the end position of the chin bar. In this way, the chin bar inserted in the receiving-brackets may also be supported in the lateral direction (in particular horizontally).

In some embodiments, the helmet system may comprise a locking device to lock the chin bar in the end position to the helmet. The locking device may comprise at least one locking opening at each of the two receiving-brackets of the helmet, wherein the locking device comprises at least one movable latch at each of the two ends of the chin bar which is configured to engage the at least one locking opening of the respective receiving-bracket in a locking position. The locking device may have at least one handle at the chin bar, by actuation of which the at least one latch is movable from the locking position into an unlocking position. Such embodiments have the advantage that the movable locking and unlocking mechanism (in particular the respective latch and the handle) is arranged at the chin bar. The helmet itself may thus be very simply configured, especially for the open face configuration.

A separate handle may be provided for each end of the chin bar, or a common handle may be provided for the latches at the two ends of the chin bar.

In some embodiments, the respective latch may also be moved from the unlocked position to the locked position by actuation of the handle so as to manually lock the chin bar to the helmet. In other embodiments, automatic locking of the chin bar may be provided when the end position is reached, in particular by biasing the at least one latch toward the locking position.

In embodiments of the chin bar having insertion wedges at the two ends and latches, the at least one locking opening of the respective receiving-bracket of the helmet may be formed at one of the two insertion flanks of the respective receiving-bracket. In such embodiments, the at least one latch of the chin bar may be configured to project out from one of the two abutment flanks of the respective insertion wedge in its locking position and to engage in the at least one locking opening of the respective receiving-bracket. In other words, the respective locking engagement may occur at the interface between an abutment flank of the chin bar and an insertion flank of the helmet. This enables a stable locking.

In some embodiments, a locking opening may be formed at each of the two insertion flanks of the respective receiving-bracket, wherein the locking device comprises two movable latches at each of the two ends of the chin bar, wherein, in its locking position, each of the two latches of the respective end of the chin bar projects out from a respective one of the two abutment flanks of the respective insertion wedge and engages in a respective one of the two locking openings of the respective receiving-bracket. Thus, at each receiving-bracket, a double locking may take place along different directions of engagement, whereby the forces transmitted between the chin bar and the helmet (in particular tensile forces against the direction of insertion or tilting moments) are distributed more evenly. As a result, a particularly stable locking of the chin bar to the helmet is thus made possible.

In some embodiments, the two latches of the respective end of the chin bar may be biased in the direction of their locking position, whereby a common handle and a deflecting device are associated with each end of the chin bar. The deflecting device may be configured to convert an actuating movement of the common handle into a respective unlocking movement of the two latches, wherein the unlocking movements of the two latches take place in different directions, in particular, in opposite directions. Thus, the two latches of the respective end of the chin bar may be moved by a simple actuation of the common handle. This facilitates the operation of the locking device. The deflecting device may comprise a slide guide and/or a deflecting incline, for example. In order to bias the respective latch in the direction of its locking position, a section of the handle or the deflecting device or the latch may be configured to be elastic (i.e. resilient), or the latch is biased, for example, by a separate spring (tension spring or compression spring).

In some embodiments, the two latches, the deflecting device and the common handle of the respective end of the chin bar may form a locking assembly, wherein the locking assemblies of the two ends of the chin bar are configured identical. This makes it possible to arrange identical locking assembly units at the left end and the right end of the chin bar. Thus, the manufacture of the chin bar is simpler and less expensive.

In some embodiments, a magnetic element may be arranged at the respective receiving-bracket of the helmet and a magnetic counter-element may be arranged at the respective end of the chin bar. The magnetic element and the magnetic counter-element may be configured to exert a magnetic force of attraction on the chin bar in the direction of its end position when the chin bar is inserted into the receiving-brackets, in order to support the insertion movement and to secure the chin bar in its end position.

The magnetic element or the magnetic counter-element may be configured to be permanently magnetic, while the respective other element is formed from a magnetizable material. Alternatively, the magnetic element and the magnetic counter-element may both be configured to be permanently magnetic.

In some embodiments, the helmet system may further comprise two ear protection modules configured to be selectively inserted into the two receiving-brackets of the helmet in place of the chin bar. Each of the two ear protection modules may—as explained for the chin bar—comprise an insertion wedge, wherein the respective insertion wedge may have two abutment flanks which are configured, at least in sections, to be complementary to the insertion flanks of the respective receiving-bracket. The abutment flanks of the ear protection modules may be configured to lie in a form-fit manner against the insertion flanks of the respective receiving-bracket in an end position of the respective ear protection module. By means of such ear protection modules, the helmet may thus be selectively converted into a jet helmet in which the helmet offers increased lateral protection, i.e. also in the area of the ears. This provides a 3-in-1 modular system.

In embodiments of the helmet system having ear protection modules and with magnetic elements at the receiving-brackets of the helmet, the two ear protection modules may be configured without a mechanical locking device, whereby each of the two ear protection modules—as explained for the chin bar—has a magnetic counter-element. The magnetic element of the respective receiving-bracket and the magnetic counter-element of the respective ear protection module may be configured to exert a magnetic force of attraction on the ear protection module in the direction of its end position when inserting the respective ear protection module, in order to support the insertion movement and to secure the respective ear protection module in its end position. Thus, in contrast to the chin bar, the magnetic counter-elements alone serve as securing devices for the inserted ear protection modules. This does not exclude the presence of additional stabilizing devices, which may be effective, in particular, in the lateral direction. Taking into account the low load on the ear protection modules compared to the chin bar, the ear protection modules may thus have a simple, compact and lightweight structure.

In some embodiments of the helmet, a stabilizing recess may be formed at the respective receiving-bracket, wherein the chin bar at its two ends and/or the ear protection modules may comprise a respective stabilizing protrusion which, in the end position of the chin bar and/or the ear protection modules, engages with a form-fit in the respective stabilizing recess, so that the chin bar and/or the ear protection modules is/are blocked against movements in directions perpendicular to the insertion direction of the chin bar and/or the ear protection modules. The stabilizing protrusion may be configured, for example, in the shape of a pin or bar, particularly having centering bevels. In some embodiments, the stabilizing protrusion may be arranged offset relative to the insertion wedge of the chin bar and/or the ear protection modules, for example, offset downward in the vertical direction.

In some embodiments, the insertion flanks, the at least one locking opening, the magnetic element and/or the stabilizing recess of the respective receiving-bracket of the helmet—if present in each case—may be formed at a common mounting unit that is integrated in a helmet body of the helmet. Such a mounting unit may, for example, be configured to be substantially plate-shaped, in particular planar or curved. A connecting device for a helmet strap may optionally also be formed at the mounting unit. Such a mounting unit may be integrated in the helmet body and anchored therein, thereby simplifying the manufacture of the helmet.

The invention also relates generally to a helmet configured to receive in a detachable manner a chin bar, wherein the helmet comprises two receiving-brackets, wherein each of the two receiving-brackets comprises two insertion flanks extending towards each other at an acute centering angle in the direction of a rear side of the helmet, wherein the insertion flanks are configured to center the chin bar in a vertical direction when being inserted.

As explained, each of the two receiving-brackets of such a helmet may have at least one locking opening, wherein the at least one locking opening of the respective receiving-bracket is formed at one of the two insertion flanks of the respective receiving-bracket. In particular, a locking opening may be formed at each of the two insertion flanks of the respective receiving-bracket. As explained, a magnetic element for securing the chin bar may further be arranged at the respective receiving-bracket.

The invention also relates generally to a helmet system comprising a helmet, a chin bar detachably mountable to the helmet and, alternatively to the chin bar, two ear protection modules detachably mountable to the helmet, wherein the helmet comprises two receiving-brackets, wherein the chin bar being insertable into the receiving-brackets of the helmet with its two ends in front, wherein the chin bar comprises a mechanical locking device which is configured to lock the chin bar in an end position in the receiving-brackets of the helmet, wherein a magnetic element is arranged at the respective receiving-bracket of the helmet and a magnetic counter-element is arranged at the respective end of the chin bar, wherein the magnetic element of the respective receiving-bracket and the magnetic counter-element of the chin bar are configured for exerting a force of attraction on the chin bar in the direction of its end position when the chin bar is inserted into the receiving-brackets, in order to support the insertion movement and to secure the chin bar in its end position, wherein the two ear protection modules are configured to be selectively inserted into the two receiving-brackets of the helmet instead of the chin bar, wherein the two ear protection modules do not have a mechanical locking device, wherein each of the two ear protection modules comprises a magnetic counter-element, wherein the magnetic element of the respective receiving-bracket and the magnetic counter-element of the respective ear protection module are configured to exert a magnetic force of attraction on the ear protection module in the direction of an end position when inserting the respective ear protection module, in order to support the insertion movement and to secure the respective ear protection module in its end position. This creates an advantageous 3-in-1 module system. The mechanical locking device of the chin bar may comprise, for example, one or more movable latches, as explained above.

BRIEF DESCRIPTION OF THE DRAWINGS

The invention is explained below merely by way of example with reference to the drawings. Identical or similar elements are identified therein with the same reference numbers.

DETAILED DESCRIPTION OF THE INVENTION

Figure 1:
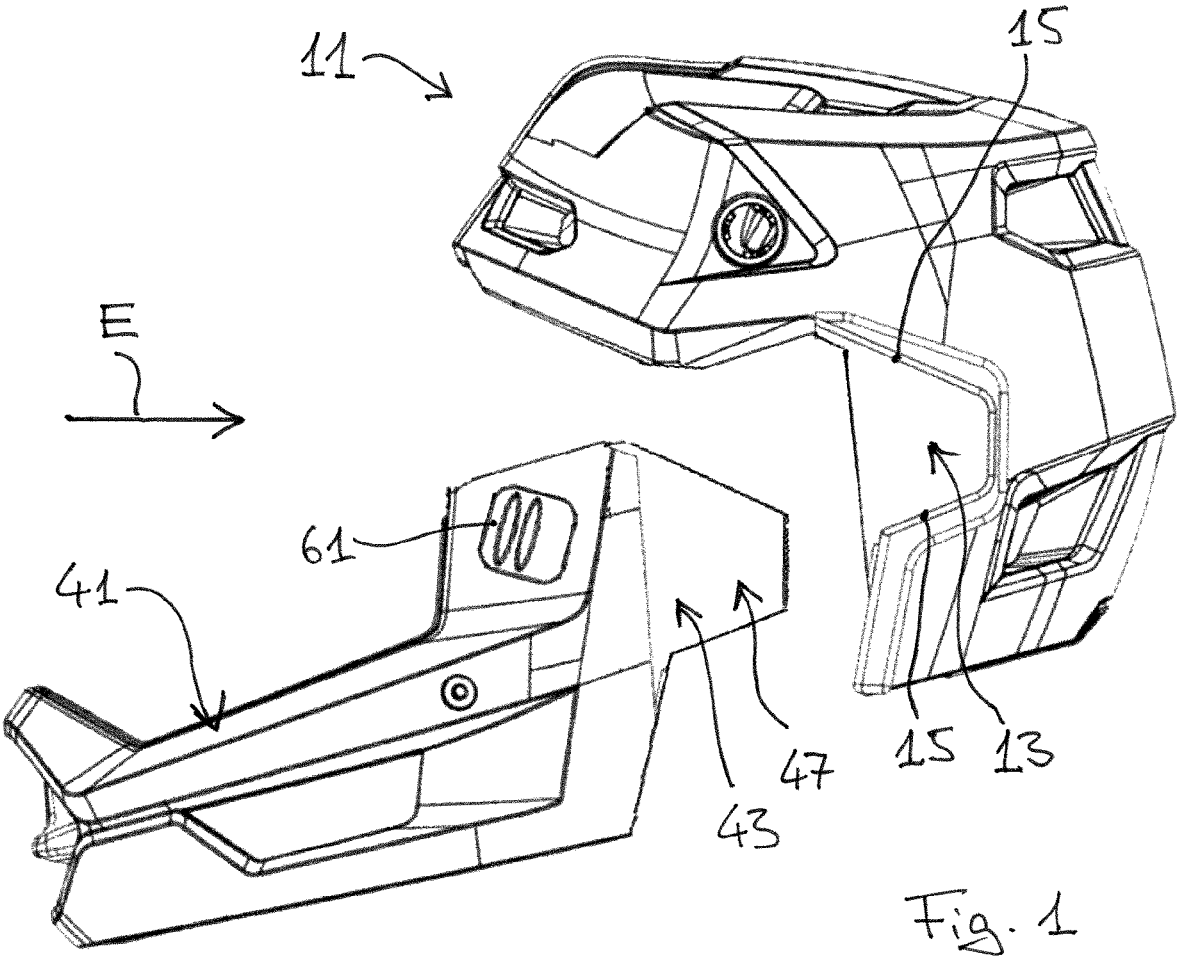
FIG. 1 shows a side view of a helmet with a chin bar detached therefrom.

FIG. 1 shows a modular helmet system comprising a helmet 11 in the form of a mountain-bike helmet and a chin bar 41 detachably mountable to the helmet 11. The helmet 11 is a so-called open face helmet with recesses in the area of the user's ears. The helmet 11 comprises two receiving-brackets 13, of which only the left receiving-bracket 13 is visible in the side view according to FIG. 1.

The chin bar 41 shown in FIG. 1 is in a detached state from the helmet 11. However, the chin bar 41 may be selectively inserted into the helmet 11 along an insertion direction E and may be detachably mounted to the helmet in order to convert the helmet 11 into a so-called full face configuration.

The chin bar 41 comprises two free ends 43, of which only the left end 43 is visible in the side view of FIG. 1. The chin bar 41 may be inserted with its two ends 43 in front in a substantially straight line into the receiving-brackets 13 of the helmet 11 and locked there after reaching an end position in the receiving-brackets 13. The chin bar 41 comprises an insertion wedge 45 at each of its two ends 43, which cooperates in a form-fit manner with the respective receiving-bracket 13 of the helmet 11 in order to effect a stable and substantially zero-play fit at the helmet 11 in the end position of the chin bar 41.

Figure 2:
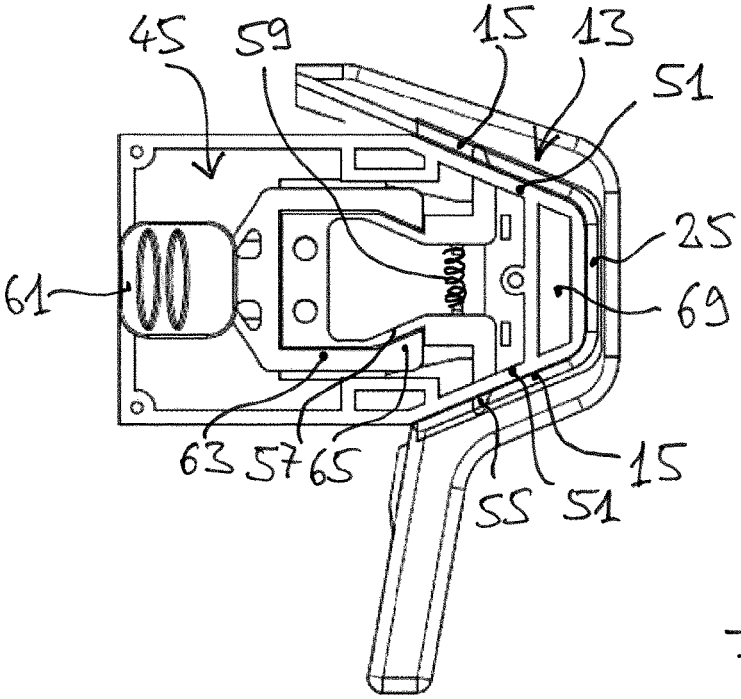
FIG. 2 shows a receiving-bracket in which an insertion wedge is inserted.

FIG. 2 shows the left receiving-bracket 13, into which the left insertion wedge 45 of the chin bar 41 is inserted.

Figure 3A:
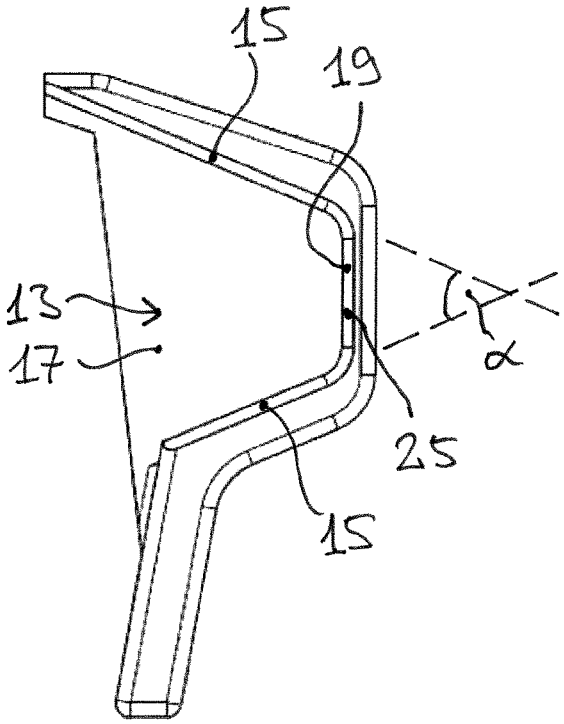
FIGS. 3A and 3B show respectively a side view and a perspective view of the receiving-bracket according to FIG. 2.
Figure 3B:
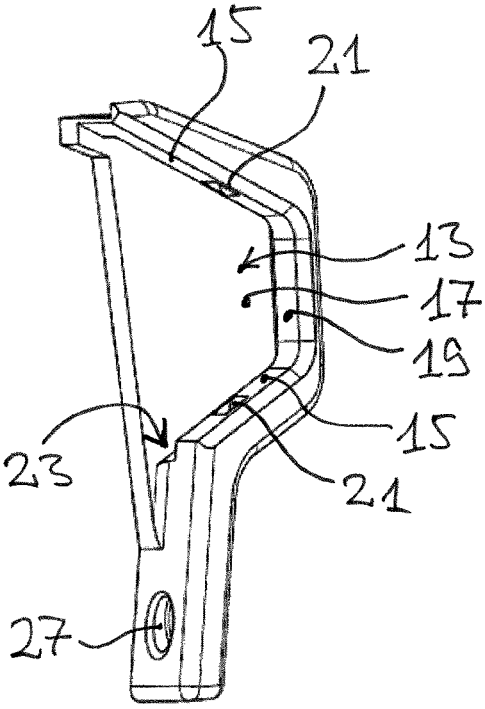

FIGS. 3A and 3B show isolated a left receiving-bracket 13. The receiving-bracket 13 comprises two insertion flanks 15 that extend away from a receiving plate 17 and extend toward each other along the insertion direction E at an acute centering angle $\alpha$. The centering angle $\alpha$ may be approximately 45 degrees, for example. The insertion flanks 15 serve to center and align the chin bar 41 in the vertical direction during insertion and to form a stop for the chin bar 41 in the end position of the chin bar 41.

The insertion flanks 15 are configured straight and lead to a connecting section 19. A locking opening 21 is formed at each of the two insertion flanks 15 of the receiving-bracket 13. A support groove 23 is configured along the lower insertion flank 15 of the receiving-bracket 13. A magnetic element 25 is arranged at the connecting section 19 of the receiving-bracket 13. Furthermore, the receiving-bracket 13 comprises a stabilizing recess 27 which is offset vertically downwards with respect to the insertion flanks 15.

The receiving plate 17 forms a common mounting unit in order to be able to integrate the insertion flanks 15 with the locking openings 21 and the support groove 23, the magnetic element 25 and the stabilizing recess 27 of the receiving-bracket 13 in a helmet body of the helmet 11.

The right receiving-bracket 13 is configured mirrored with respect to the left receiving-bracket 13 shown in FIGS. 3A and 3B.

Figure 4A:
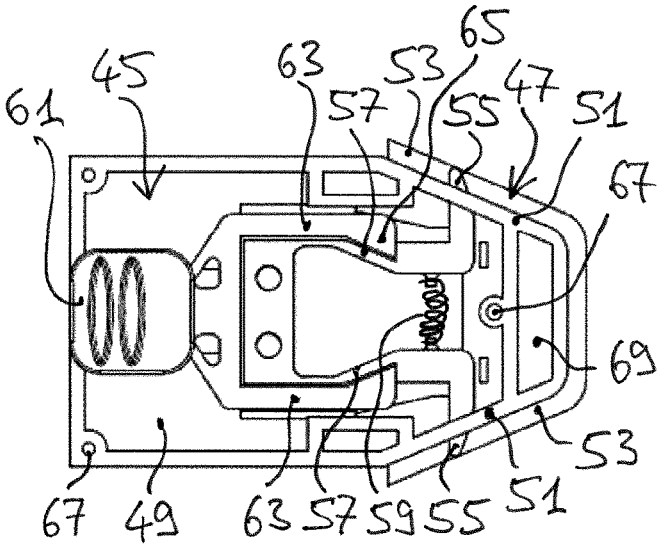
FIGS. 4A and 4B show respectively a side view and a perspective view of the insertion wedge according to FIG. 2.
Figure 4B:
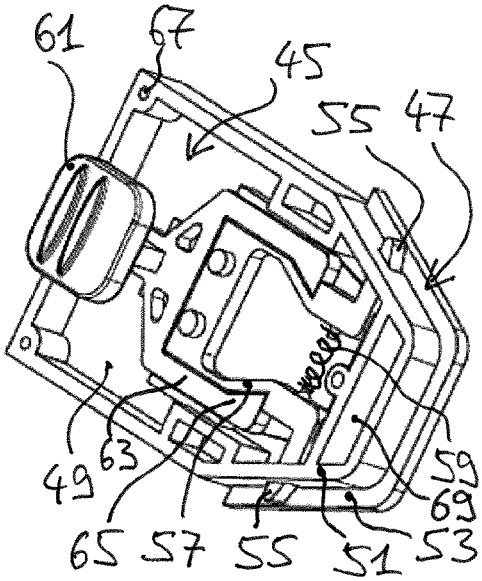

FIGS. 4A and 4B show isolated the left insertion wedge 45 of the chin bar 41. The insertion wedge 45 comprises an insertion section 47 having a trapezoidal contour. The insertion wedge 45 comprises a plate-shaped support 49 at which two abutment flanks 51 are formed. The abutment flanks 51 are configured complementary to the insertion flanks 15 of the respective receiving-bracket 13 of the helmet 11 in such a way that, in the described end position of the chin bar 41, the abutment flanks 51 lie with a form-fit against the insertion flanks 15 of the respective receiving-bracket 13. Furthermore, the plate-shaped support 49 of the insertion wedge 45 comprises two support ribs 53, one of which is configured to engage in the support groove 23 of the respective receiving-bracket 13 of the helmet 11 in the described end position of the chin bar 41.

The helmet system shown comprises a locking device for locking the chin bar 41 in its end position to the helmet 11. On the side of the respective receiving-bracket 13 of the helmet 11, the locking device comprises the locking openings 21 at the insertion flanks 15. On the side of the respective end 43 of the chin bar 41, the locking device comprises two movable latches 55 which, in a locking position, are configured to respectively engage in one of the two locking openings 21 of the associated receiving-bracket 13. Each of the two latches 55 is mounted to the support 49 via a spring arm 57. The two spring arms 57 are pressed apart by a spring 59 implemented as a compression spring. As a result, the two latches 55 are biased toward the locking position shown in FIGS. 4A and 4B.

On the side of the respective end 43 of the chin bar 41, the locking device further comprises a handle 61 in the form of a slide which is mounted at the support 49 such that it is movable in a straight line. The handle 61 is connected to two control bars 63, each of which lies with a respective deflecting incline 65 against one of the two spring arms 57. This forms a deflecting device, whereby by manually moving the handle 61 away from the latches 55 the deflecting inclines 65 deflect the spring arms 57 against the pretension force of the spring 59. As a result, the latches 55 are moved from the locked position shown in FIGS. 4A and 4B toward an unlocked position in which the latches 55 no longer project from the abutment flanks 51 of the insertion wedge 45.

The support 49 with the two abutment flanks 51 and the support ribs 53, the two latches 55 and the handle 61 of the respective insertion wedge 45 form a locking assembly which may be configured identical for the two ends 43 of the chin bar 41 (left and right end 43). The support 49 may be mounted to the chin bar, for example, via fastening openings 67.

A magnetic counter-element 69 is further arranged at the insertion wedge 45. The magnetic element 25 of the respective receiving-bracket 13 of the helmet 11 and the magnetic counter-element 69 of the associated end 43 of the chin bar 41 are configured to exert a magnetic force of attraction on the chin bar 41 in the direction of its end position when the chin bar 41 is inserted into the receiving-brackets 13, in order to support the insertion movement and to secure the chin bar 41 in its end position. The magnetic elements 25 and magnetic counter-elements 69 may also be arranged at positions other than those shown in FIGS. 3 and 4, or additional magnetic elements and magnetic counter-elements may also be provided.

The chin bar 41 comprises a respective stabilizing protrusion at its two ends 43, which in the described end position of the chin bar 41 engages in a form-fit manner with the stabilizing recess 27 of the associated receiving-bracket 13, in order to block the chin bar 41 against movements in directions perpendicular to the insertion direction E of the chin bar 41. The stabilizing protrusion may be arranged in particular at an end face set back of the respective end 43 of the chin bar 41 (thus not visible in the side view of FIG. 1).

Figure 5:
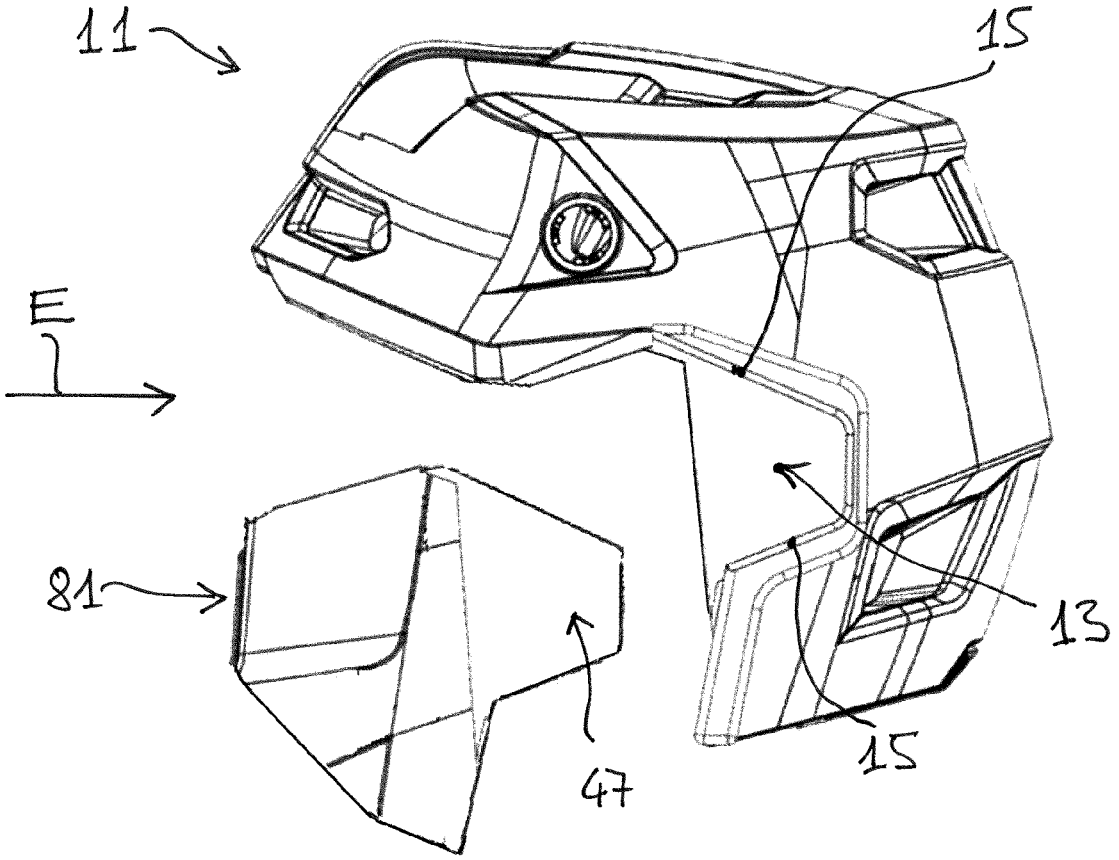
FIG. 5 shows the helmet according to FIG. 1 having an ear protection module detached therefrom.

FIG. 5 illustrates an optional further embodiment of the modular helmet system, in which the helmet system further comprises two ear protection modules 81. The two ear protection modules 81 may selectively be inserted, instead of the chin bar 41, along the insertion direction E into the two receiving-brackets 13 of the helmet 11, in order to convert the helmet 11 into a so-called jet helmet configuration.

Each of the two ear protection modules 81 may in turn comprise an insertion wedge, wherein the respective insertion wedge comprises two abutment flanks which are configured complementary to the insertion flanks 15 of the respective receiving-bracket 13 of the helmet 11. As explained in relation to the chin bar 41, in an end position of the respective ear protection module 81, the abutment flanks of the ear protection modules 81 may lie with a form-fit against the insertion flanks 15 of the respective receiving-bracket 13. Furthermore, each of the two ear protection modules 81 may have a magnetic counter-element in order to exert a magnetic force of attraction on the ear protection module 81 in the direction of its end position when inserting the respective ear protection module 81, as explained in relation to the chin bar 41. As a result, the insertion movement may be supported and the respective ear protection module 81 may be secured in its end position. However, in contrast to the chin bar 41, the two ear protection modules 81 do not have a mechanical locking device, in particular do not have the latch 55 and the handle 61. As a result, the ear protection modules 81 may have a compact and lightweight design.

The explained helmet 11 has the advantage that the chin bar 41 may be mounted in a simple manner, even while the user is wearing the helmet 11. The chin bar 41 need only be inserted from the front in a substantially straight line into the receiving-brackets 13 of the helmet 11, wherein the insertion flanks 15 of the receiving-brackets 13 ensure the necessary centering without the need to actively perform additional pivoting movements. In the end position, the chin bar 41 is arranged in a stable orientation on the helmet 11 and may in particular also be supported in the lateral direction. The locking device (latch 55, handle 61) is stable and easy to operate. The locking of the inserted chin bar 41 may take place automatically. The locking device is arranged almost entirely at the chin bar 41, so that the helmet 41 is very easily formed in the open face configuration. Since the respective locking assembly at the two ends 43 of the chin bar 41 (support 49 with abutment flanks 51 and support ribs 53, latch 55, handle 61) may be configured identical, the helmet system may be manufactured cost-effective. Due to the combination of mechanical locking and magnetic securing, the helmet system may easily be extended to a 3-in-1 modular system, which additionally provides a jet helmet configuration having a compact and lightweight design of the ear protection modules 81, which are only magnetically secured.

What is claimed is:

1. A modular helmet system comprising a helmet and a chin bar detachably mountable to the helmet, wherein the helmet comprises two receiving-brackets, wherein the chin bar is insertable into the receiving-brackets of the helmet with two ends of the chin bar along an insertion direction in a substantially straight line, wherein the chin bar is lockable in the receiving-brackets in an end position, wherein each of the two receiving-brackets comprises two insertion flanks which extend towards each other along the insertion direction at an acute centering angle, wherein the insertion flanks are configured to center the chin bar between the insertion flanks when being inserted and to form a stop for the chin bar in the end position of the chin bar;

wherein the helmet system comprises a locking device for locking the chin bar in the end position to the helmet, wherein the locking device comprises at least one locking opening at each of the two receiving-brackets of the helmet, wherein the locking device comprises at least one movable latch at each of the two ends of the chin bar which is configured to engage in the at least one locking opening of the respective receiving-bracket in a locking position, and wherein the locking device comprises at least one handle at the chin bar, through actuation of the at least one handle the at least one latch is moved out of the locking position into an unlocking position.

2. The modular helmet system according to claim 1, wherein the insertion flanks of the respective receiving-bracket are formed as rectilinear, at least in sections.

3. The modular helmet system according to claim 1, wherein the centering angle has a value in a range from 30 degrees to 60 degrees.

4. The modular helmet system according to claim 1, wherein the chin bar comprises a respective insertion wedge at each of its two ends, wherein the respective insertion wedge comprises two abutment flanks which are configured, at least in sections, to be complementary to the insertion flanks of the respective receiving-bracket of the helmet, wherein the abutment flanks lie in a form-fit manner against the insertion flanks of the respective receiving-bracket in the end position of the chin bar.

5. The modular helmet system according to claim 4, wherein each of the two insertion wedges comprises an insertion section having a trapezoidal contour.

6. The modular helmet system according to claim 4, wherein each of the two receiving-brackets comprises a support groove at at least one of the two insertion flanks, wherein each of the two insertion wedges comprises a respective support rib at at least one of the two abutment flanks which projects in a vertical direction from the respective abutment flank, and wherein the respective support rib engages in the support groove of the respective receiving-bracket in the end position of the chin bar.

7. The modular helmet system according to claim 4, wherein the at least one locking opening of the respective receiving-bracket is formed at one of the two insertion flanks of the respective receiving-bracket, and wherein the at least one latch projects out of one of the two abutment flanks of the respective insertion wedge in the locking position and engages in the at least one locking opening of the respective receiving-bracket.

8. The modular helmet system according to claim 7, wherein the at least one locking opening comprises two locking openings formed at each of the two insertion flanks of the respective receiving-bracket, wherein the at least one moveable latch comprises two movable latches at each of the two ends of the chin bar, wherein each of the two latches of the respective end of the chin bar projects from a respective one of the two abutment flanks of the respective insertion wedge and engages in a respective one of the two locking openings of the respective receiving-bracket in the locking position.

9. The modular helmet system according to claim 8, wherein the at least one handle is a common handle, the two latches of the respective end of the chin bar are biased towards their locking position, wherein the two ends of the chin bar are associated with the common handle and a deflecting device, wherein the deflecting device converts an actuating movement of the common handle into a respective unlocking movement of the two latches, whereby the unlocking movements of the two latches take place in different directions.

10. The modular helmet system according to claim 9, wherein the two latches, the deflecting device and the common handle of the two ends of the chin bar form a locking assembly, wherein the locking assemblies of the two ends of the chin bar are configured identical.

11. The modular helmet system according to claim 1, wherein a magnetic element is arranged at the respective receiving-bracket and a magnetic counter-element is arranged at the respective end of the chin bar, wherein the magnetic element and the magnetic counter-element exert a magnetic force of attraction on the chin bar when the chin bar is being inserted into the receiving-brackets, in order to support an insertion movement and to secure the chin bar in its end position.

12. The modular helmet system according to claim 1, wherein the helmet system further comprises two ear protection modules which are configured to be selectively inserted into the two receiving-brackets of the helmet instead of the chin bar, wherein each of the two ear protection modules comprises an insertion wedge, wherein the respective insertion wedge comprises two abutment flanks which are configured, at least in sections, to be complementary to the insertion flanks of the respective receiving-bracket, wherein the abutment flanks of the ear protection modules are lie in a form-fitting manner against the insertion flanks of the respective receiving-bracket in an end position of the respective ear protection module.

13. The modular helmet system according to claim 1, wherein a magnetic element is arranged at the respective receiving-bracket and a magnetic counter-element is arranged at the respective end of the chin bar, wherein the magnetic element and the magnetic counter-element exert a magnetic force of attraction on the chin bar when the chin bar is being inserted into the receiving-brackets, in order to support an insertion movement and to secure the chin bar in its end position;

wherein the helmet system further comprises two ear protection modules which are configured to be selectively inserted into the two receiving-brackets of the helmet instead of the chin bar, wherein each of the two ear protection modules comprises an insertion wedge, wherein the respective insertion wedge comprises two abutment flanks which are configured, at least in sections, to be complementary to the insertion flanks of the respective receiving-bracket, wherein the abutment flanks of the ear protection modules lie in a form-fitting manner against the insertion flanks of the respective receiving-bracket in an end position of the respective ear protection module; and wherein the two ear protection modules do not have a mechanical locking device, wherein each of the two ear protection modules comprises a magnetic counter-element, wherein the magnetic element of the respective receiving-bracket and the magnetic counter-element of the respective ear protection module are configured to exert a magnetic force of attraction on the ear protection module when the respective ear protection module is being inserted, in order to support an insertion movement and to secure the respective ear protection module in its end position.

14. A modular helmet system comprising a helmet and a chin bar detachably mountable to the helmet, wherein the helmet comprises two receiving-brackets, wherein the chin bar is insertable into the receiving-brackets of the helmet with two ends of the chin bar along an insertion direction in a substantially straight line into an end position, wherein each of the two receiving-brackets comprises two insertion flanks which extend towards each other along the insertion direction at an acute centering angle, wherein the insertion flanks are configured to center the chin bar between the insertion flanks when being inserted and to form a stop for the chin bar in the end position of the chin bar, wherein the chin bar comprises a respective insertion wedge at each of its two ends, wherein the respective insertion wedge comprises two abutment flanks which are formed, at least in sections, complementary to the insertion flanks of the respective receiving-bracket of the helmet, wherein the abutment flanks lie in a form-fit manner against the insertion flanks of the respective receiving-bracket in the end position of the chin bar, wherein each of the two receiving-brackets comprises a support groove at at least one of the two insertion flanks, wherein each of the two insertion wedges comprises a respective support rib at at least one of the two abutment flanks which projects in a vertical direction from the respective abutment flank, wherein the respective support rib engages in the support groove of the respective receiving-bracket in the end position of the chin bar, wherein the helmet system comprises a locking device for locking the chin bar in the end position to the helmet, wherein the locking device comprises at least one locking opening at each of the two receiving-brackets of the helmet, wherein the locking device comprises at least one movable latch at each of the two ends of the chin bar which is configured to engage in the at least one locking opening of the respective receiving-bracket in a locking position, and wherein the locking device comprises at least one handle at the chin bar, through actuation of the at least one handle the at least one latch is moved out of the locking position into an unlocking position.

15. The modular helmet system according to claim 14, wherein a stabilizing recess is formed at the respective receiving-bracket, wherein the chin bar comprises a respective stabilizing protrusion at its two ends which engages in a form-fitting manner with the respective stabilizing recess in the end position of the chin bar, so that the chin bar is blocked against movements in directions perpendicular to the insertion direction of the chin bar.

16. A modular helmet system comprising a helmet and a chin bar detachably mountable to the helmet, wherein the helmet comprises two receiving-brackets, wherein the chin bar is insertable into the receiving-brackets of the helmet with two ends of the chin bar along an insertion direction in a substantially straight line into an end position, wherein each of the two receiving-brackets comprises two insertion flanks which are configured to center the chin bar between the insertion flanks when being inserted into the receiving-brackets, wherein the insertion flanks form a stop for the chin bar in the end position of the chin bar, wherein the chin bar comprises two abutment flanks at each of its two ends, wherein the two abutment flanks which are formed, at least in sections, complementary to the insertion flanks of the respective receiving-bracket of the helmet, wherein the abutment flanks lie in a form-fit manner against the insertion flanks of the respective receiving-bracket in the end position of the chin bar, wherein the helmet system comprises a locking device for locking the chin bar in the end position to the helmet, wherein the locking device comprises a respective locking opening at each of the two insertion flanks of each of the two receiving-brackets of the helmet, wherein the locking device comprises two movable latches at each of the two ends of the chin bar, wherein each of the two latches of the respective end of the chin bar projects from a respective one of the two abutment flanks of the respective end of the chin bar, wherein each of the two latches engages into a respective one of the two locking openings of the respective receiving-bracket in a locking position, wherein the locking device comprises at two ends of the chin bar a common handle, through actuation of the common handle, the two latches of the respective end of the chin bar are moved out of the locking position into an unlocking position.

17. The modular helmet system according to claim 16, wherein each end of the chin bar comprises a deflecting device which converts an actuating movement of the common handle into a respective unlocking movement of the two latches of the respective end of the chin bar, whereby the unlocking movements of the two latches take place in different directions.

18. The modular helmet system according to claim 17, wherein the two latches of the respective end of the chin bar are biased towards their locking position.

* * * * *